US008287658B2

(12) United States Patent
Miralles et al.

(10) Patent No.: US 8,287,658 B2
(45) **Date of Patent: *Oct. 16, 2012**

(54) BIODEGRADABLE SURFACTANT BLEND

(75) Inventors: Altony J. Miralles, Woodbury, MN (US); Amanda R. Blattner, Prior Lake, MN (US); Charles A. Hodge, Cottage Grove, MN (US)

(73) Assignee: Ecolab USA Inc., St. Paul, MN (US)

( * ) Notice: Subject to any disclaimer, the term of this patent is extended or adjusted under 35 U.S.C. 154(b) by 57 days.

This patent is subject to a terminal disclaimer.

(21) Appl. No.: 12/476,594

(22) Filed: Jun. 2, 2009

(65) Prior Publication Data

US 2010/0305014 A1 Dec. 2, 2010

(51) Int. Cl.
*B08B 3/04* (2006.01)
*C11D 1/72* (2006.01)
*C11D 3/22* (2006.01)

(52) U.S. Cl. ..... 134/25.2; 134/25.3; 134/39; 134/42; 510/238; 510/239; 510/240; 510/245; 510/360; 510/421; 510/474; 8/137

(58) Field of Classification Search ..... 510/238, 510/239, 240, 245, 360, 421, 474; 134/25.2, 134/25.3, 39, 42; 8/137
See application file for complete search history.

(56) References Cited

U.S. PATENT DOCUMENTS 5,770,549 A * 6/1998 Gross ..... 510/238

FOREIGN PATENT DOCUMENTS

WO WO 2004/053043 A1 6/2004
WO WO 2005/118767 A1 12/2005
WO WO 2007/036497 A1 4/2007

* cited by examiner

*Primary Examiner* — Brian P Mruk
(74) *Attorney, Agent, or Firm* — Andrew D. Sorensen; Laura C. DiLorenzo; Amy J. Hoffman

(57) ABSTRACT

A degreasing composition is disclosed comprising an alkyl polyglucoside; and a nonionic surfactant having a carbon chain of $C_6$ or less. The nonionic surfactant comprises linear $C_6$ alcohol ethoxylate. In an embodiment the linear $C_6$ alcohol ethoxylate comprises from about 3 to about 6 moles of ethylene oxide. In another embodiment the alkyl polyglucoside and the alcohol ethoxylate comprise an active ratio of from about 3:1 to about 1:1 in the composition. The composition of the invention is useful in formulating a laundry detergent, a hard surface cleaner, an automatic dishwashing detergent, a hand dishwashing detergent, an oven cleaner, hand soap, or an automotive detergent.

7 Claims, 7 Drawing Sheets

BIODEGRADABLE SURFACTANT BLEND

FIELD OF THE INVENTION

The present invention generally relates to a novel composition. More particularly, the present invention relates to a non-solvent composition useful for removing soils and grease from a variety of surfaces.

BACKGROUND

Nonylphenol ethoxylates are well-known surfactants commonly referred to as NPEs. NPE are effective at removing soils containing grease from a variety of surfaces. While NPE-containing compositions may be effective cleansers and degreasers, nonylphenol is a material recognized as hazardous by the United States Environmental Protection Agency.

Nonylphenol ethoxylate is formed through the combination of ethylene oxide with nonylphenol (NP). Both NP and NPE exhibit estrogen-like properties and provide risks for the public involving consumption of contaminated water, consumption of contaminated vegetation, or consumption of contaminated fish. NPE is not readily biodegradable and remains in the environment or food chain for indefinite time periods. Due to the risks posed to humans and animals and environmental concerns, there is presently a need to replace NPE with a biodegradable alternative.

SUMMARY

The present invention provides a composition effective at removing soils and grease from a variety of surfaces. The present invention provides an environmentally friendlier alternative to nonylphenol ethoxylate-containing compounds. Known degreasing compositions typically employ solvents, harmful to the environment, which act as carriers for the surfactants contained therein. The surfactant blend of the present invention surprisingly does not require the use of a solvent, thereby imparting a significantly enhanced ecotoxicological profile onto its degreasing compositions.

A composition is disclosed, comprising an alkyl polyglucoside and a nonionic surfactant having a carbon chain of $C_6$ or less. In one embodiment the nonionic surfactant comprises a linear $C_6$ alcohol ethoxylate. In an exemplary embodiment the linear $C_6$ alcohol ethoxylate comprises from about 3 to about 6 moles of ethylene oxide. In another embodiment the alkyl polyglucoside and the alcohol ethoxylate comprise an active ratio of from about 3:1 to about 2:1 to about 1:1 in the composition.

The composition of the invention is useful in preparing a laundry detergent, a hard surface cleaner, an automatic dishwashing detergent, a hand dishwashing detergent, an oven cleaner, hand soap, or an automotive detergent to name a few. A composition of the present invention is useful in cleaning any surface containing an oily or grease-containing soil.

Advantages associated with the cleaning compositions prepared according to the present invention are numerous including that it is a substantially solvent-free cleaner and does not contain NPE. Due to the hydrotrope properties of the alkyl polyglucoside surfactant component, more builders and hydrophobic surfactants may be incorporated into the composition. The present composition also possesses enhanced emulsification properties with respect to both polar and nonpolar oils, thereby imparting superior grease cutting properties to the composition at reduced formulation costs.

BRIEF DESCRIPTION OF THE FIGURES

FIG. 1 is a plot comparing percent red soil removal from vinyl tiles by Composition D(b) prepared according to the invention against a Control and two Comparative Examples I(b) and VII.

FIG. 2 is a plot comparing percent red soil removal from vinyl tiles by Compositions B & C prepared according to the invention against a Control and Comparative Example I.

FIG. 3 is a plot comparing percent red soil removal from vinyl tiles by Compositions D, E, F, and G prepared according to the invention against a Control and Comparative Examples II and III.

FIG. 4 is a plot comparing percent red soil removal from vinyl tiles by Compositions H, I, J, and K prepared according to the invention against a Control and Comparative Examples IV, V, and VI.

FIG. 5 is a plot comparing percent red soil removal from vinyl tiles by Compositions F, F(b), and F(d) prepared according to the invention against a Control and Comparative Examples II, III, and III(b).

FIG. 6 is a plot comparing percent red soil removal from vinyl tiles by Composition D prepared according to the invention against a Control and Comparative Example I.

FIG. 7 is a plot comparing percent red soil removal from vinyl tiles by Compositions D and D(b) prepared according to the invention against a Control.

DETAILED DESCRIPTION

Figure 1:
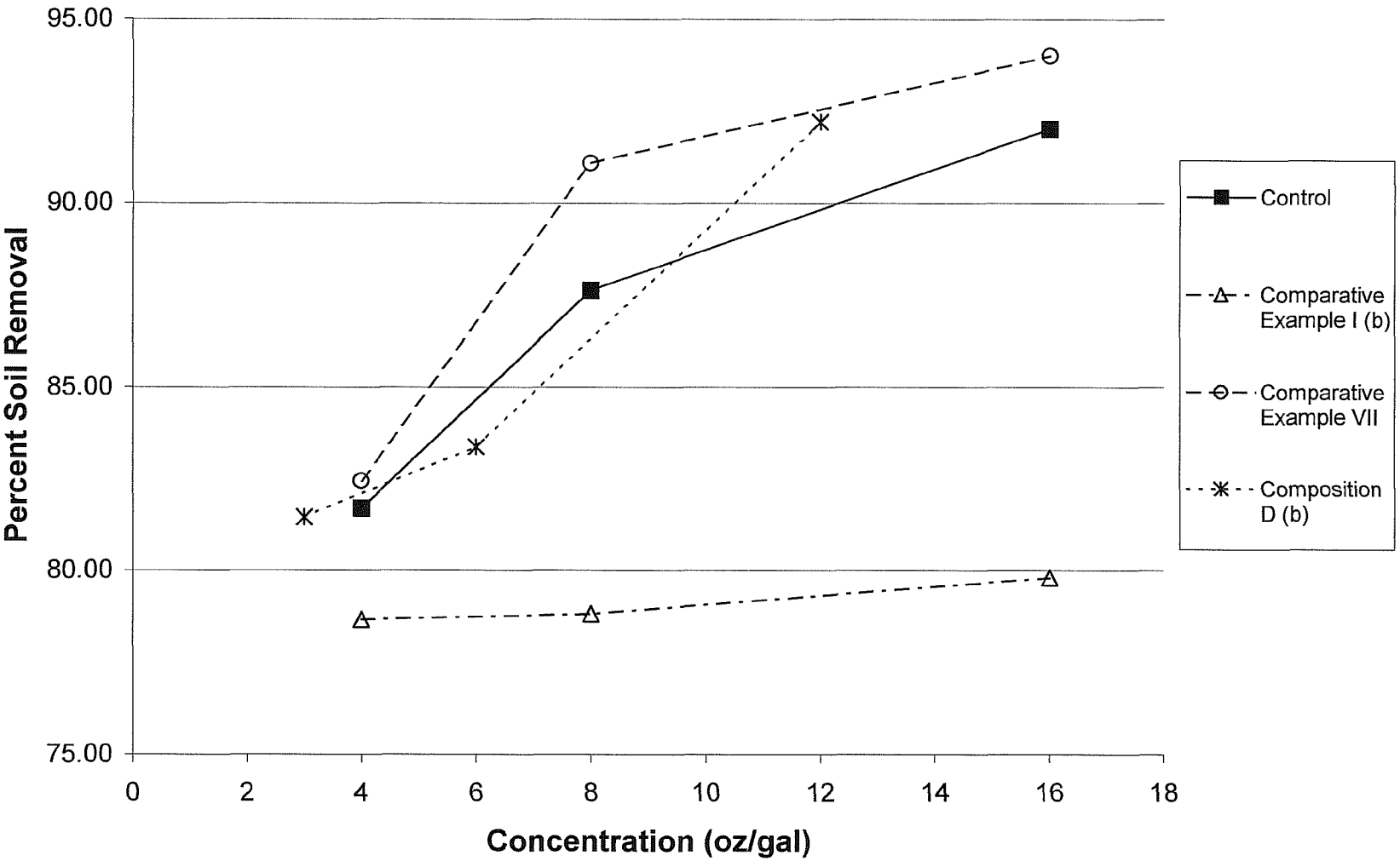
FIGS. 1-7 are plots of percent soil removed (y axis) per concentration of sample composition (x axis). All compositions referred to in the Figures were prepared according to the compositions provided in Table 1 below.
Figure 2:
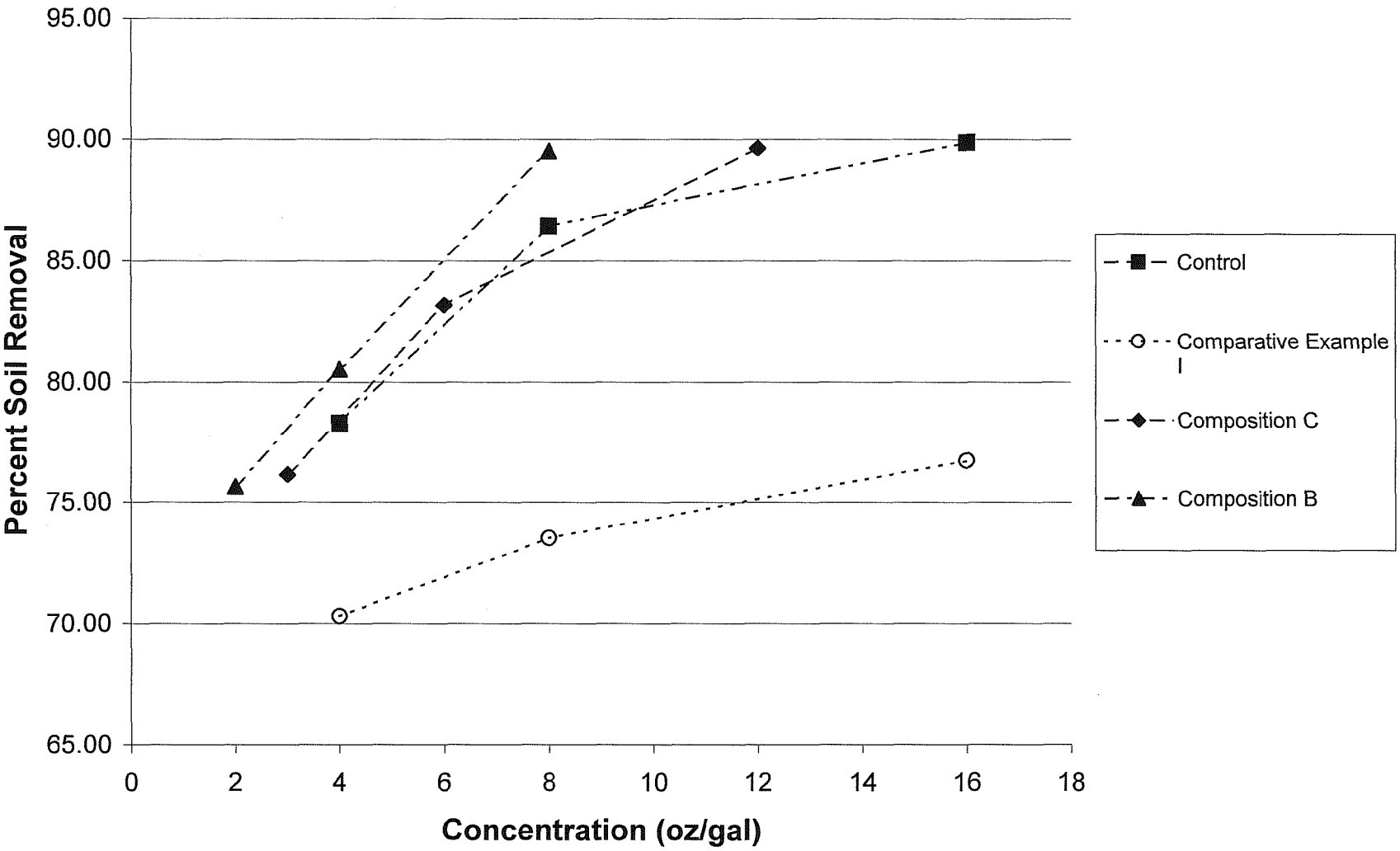

As used herein, the term "solvent-free" refers to a composition, mixture, or ingredients that does not contain a solvent or solvent-containing compound or to which a solvent or solvent-containing compound has not been added. Should a solvent or solvent-containing compound be present through contamination of a solvent-free composition, mixture, or ingredients, the amount of solvent shall be less than 0.5 wt %. In another embodiment, the amount of solvent is less then 0.1 wt-% and in yet another embodiment, the amount of solvent is less than 0.01 wt %.

As used herein, the terms "phosphate-free" or "phosphorus-free" refers to a composition, mixture, or ingredients that do not contain phosphate, phosphorus or a phosphate or phosphorus-containing compound or to which phosphate, phosphorus or a phosphate or phosphorus-containing compound has not been added. Should phosphate, phosphorus or a phosphate or phosphorus-containing compound be present through contamination of a phosphate-free or phosphorus-free composition, mixture, or ingredients, the amount of phosphate or phosphorus shall be less than 0.5 wt %. In another embodiment, the amount of phosphate or phosphorus is less than 0.1 wt-% and in yet another embodiment, the amount of phosphate or phosphorus is less than 0.01 wt %.

Other than in the operating examples, or where otherwise indicated, all numbers expressing quantities of ingredients or reaction conditions used herein are to be understood as being modified in all instances by the term "about".

As used herein, weight percent (wt-%), percent by weight, % by weight, and the like are synonyms that refer to the concentration of a substance as the weight of that substance divided by the total weight of the composition and multiplied by 100.

As used herein, the term "about" modifying the quantity of an ingredient in the compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities.

The term "alkyl" refers to a straight or branched chain monovalent hydrocarbon radical having a specified number of carbon atoms. Alkyl groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halogen, for example. Examples of "alkyl" include, but are not limited to, methyl, ethyl, n-propyl, isopropyl, n-butyl, s-butyl, t-butyl, n-pentyl, n-hexyl, 3-methylpentyl, and the like.

The term "surfactant" or "surface active agent" refers to an organic chemical that when added to a liquid changes the properties of that liquid at a surface.

"Cleaning" means to perform or aid in soil removal, bleaching, microbial population reduction, rinsing, or combination thereof.

As used herein, the term "substantially free" refers to compositions completely lacking the component or having such a small amount of the component that the component does not affect the effectiveness of the composition. The component may be present as an impurity or as a contaminant and shall be less than 0.5 wt %. In another embodiment, the amount of the component is less then 0.1 wt-% and in yet another embodiment, the amount of component is less than 0.01 wt %.

As used herein, the term "ware" includes items such as eating and cooking utensils. As used herein, the term "warewashing" refers to washing, cleaning, or rinsing ware.

As used herein, the term "hard surface" includes showers, sinks, toilets, bathtubs, countertops, windows, mirrors, transportation vehicles, floors, and the like. These surfaces can be those typified as "hard surfaces" (such as walls, floors, bedpans)

As used herein, a solid cleaning composition refers to a cleaning composition in the form of a solid such as a powder, a particle, an agglomerate, a flake, a granule, a pellet, a tablet, a lozenge, a puck, a briquette, a brick, a solid block, a unit dose, or another solid form known to those of skill in the art. The term "solid" refers to the state of the detergent composition under the expected conditions of storage and use of the solid detergent composition. In general, it is expected that the detergent composition will remain in solid form when exposed to temperatures of up to about 100° F. and greater than about 120° F. A cast, pressed, or extruded "solid" may take any form including a block. When referring to a cast, pressed, or extruded solid it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid cast composition can range from that of a fused solid block, which is relatively dense and hard, for example, like concrete, to a consistency characterized as being malleable and sponge-like, similar to caulking material.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The term "actives" or "percent actives" or "percent by weight actives" or "actives concentration" are used interchangeably herein and refers to the concentration of those ingredients involved in cleaning expressed as a percentage minus inert ingredients such as water or salts.

Alkyl Polyglucoside

Compositions of the present invention comprise at least an alkyl polyglucoside component and a nonionic surfactant having a carbon chain of $C_6$ or less. Alkyl polyglucosides useful in compositions of the invention include but are not limited to those that are commercially available from Henkel Corporation located in Ambler, Pa. These include, for example, those surfactants available as APG®, GLUCOPON® or PLANTAREN®. Examples of such surfactants include but are not limited to: APG®225 Surfactant (an alkyl polyglucoside in which the alkyl group contains 8 to 10 carbon atoms and having an average degree of polymerization of 1.7); GLUCOPON®425 Surfactant (an alkyl polyglucoside in which the alkyl group contains 8 to 16 carbon atoms and having an average degree of polymerization of 1.48); GLUCOPON®625 Surfactant (an alkyl polyglucoside in which the alkyl groups contains 12 to 16 carbon atoms and having an average degree of polymerization of 1.6); APG® 325 Surfactant (an alkyl polyglucoside in which the alkyl groups contains 9 to 11 carbon atoms and having an average degree of polymerization of 1.5); GLUCOPON® 600 Surfactant (an alkyl polyglucoside in which the alkyl groups contains 12 to 16 carbon atoms and having an average degree of polymerization of 1.4); PLANTAREN® 2000 Surfactant (a $C_{8-16}$ alkyl polyglucoside in which the alkyl group contains 8 to 16 carbon atoms and having an average degree of polymerization of 1.4); and PLANTAREN® 1300 Surfactant (a $C_{12-16}$ alkyl polyglucoside in which the alkyl groups contains 12 to 16 carbon atoms and having an average degree of polymerization of 1.6).

Other alkyl polyglucosides which can be used in the compositions according to the invention are those in which the alkyl moiety contains from 6 to 18 carbon atoms and the average carbon chain length of the composition is from about 9 to about 14 comprising a mixture of two or more of at least binary components of alkyl polyglucosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglucosides derived from an acid-catalyzed reaction of an alcohol containing 6-20 carbon atoms and a suitable saccharide from which excess alcohol has been separated.

Alcohol Ethoxylate

The linear alcohol ethoxylates useful in the present invention are generally the $C_6$ straight-chain alcohols that are ethoxylated with from about 3 to about 6 moles of ethylene oxide. Their derivation is well known in the art.

In an exemplary embodiment of the present invention, the linear alcohol ethoxylate is a six carbon or less alkoxylated alcohol with 3 to 6 moles of ethylene oxide. An exemplary formulation parameter of the invention is that the cleaning composition comprises the alkyl polyglucoside and linear alcohol ethoxylate in a percent active ratio of from about 3:1 to about 2:1 to about 1:1, respectively.

The composition of the invention can include water. The composition of the invention may be provided as a concentrate wherein the composition is substantially free of any added water or the concentrate may contain a nominal amount of water. In an alternate embodiment, the composition of the invention may be provided as a ready-to-use (RTU) composition. If the composition of the invention is provided as a RTU composition, a more significant amount of water is added to the composition of the invention as a diluent. In the case of a liquid concentrate, it is expected that water will be present in a range of between about 0 wt. % and about 90 wt. %, between about 20 wt. % and about 85 wt. %, and between about 30 wt. % and about 80 wt. %, between about 50 and 80 wt. %. It should be additionally appreciated that the water may be provided as deionized water or as softened water.

In the case of a RTU composition, it should be noted that the above-disclosed cleaning composition may, if desired, be further diluted with up to about 96% by weight of water, based on the weight of the cleaning composition.

It should be understood that the water provided as part of the concentrate can be relatively free of hardness. It is expected that the water can be deionized to remove a portion of the dissolved solids. The concentrate is then diluted with water available at the locale or site of dilution and that water may contain varying levels of hardness depending upon the locale. Although deionized is preferred for formulating the concentrate, the concentrate can be formulated with water that has not been deionized. That is, the concentrate can be formulated with water that includes dissolved solids, and can be formulated with water that can be characterized as hard water.

Service water available from various municipalities has varying levels of hardness. It is desirable to provide a concentrate that can handle the hardness levels found in the service water of various municipalities. The water of dilution that can be used to dilute the concentrate can be characterized as hard water when it includes at least 1 grain hardness. It is expected that the water of dilution can include at least 5 grains hardness, at least 10 grains hardness, or at least 20 grains hardness.

It is expected that the concentrate will be diluted with the water of dilution in order to provide a use solution having a desired level of detersive properties. If the use solution is required to remove tough or heavy soils, it is expected that the concentrate can be diluted with the water of dilution at a weight ratio of at least 1:1 and up to 1:8. If a light duty cleaning use solution is desired, it is expected that the concentrate can be diluted at a weight ratio of concentrate to water of dilution of up to about 1:256.

Other Additives

The composition of the invention can include other additives, including conventional additives such as bleaching agents, hardening agents or solubility modifiers, defoamers, anti-redeposition agents, threshold agents, stabilizers, dispersants, enzymes, aesthetic enhancing agents (i.e., dye, perfume), and the like. Adjuvants and other additive ingredients will vary according to the type of composition being manufactured. It should be understood that these additives are optional and need not be included in the cleaning composition. When they are included, they can be included in an amount that provides for the effectiveness of the particular type of component.

The cleaning composition may also include builders and auxiliaries typically employed in such cleaning preparations. Examples of suitable builders which may be used include, but are not limited to, TSPP, STPP, silicates and citrates. Similarly, examples of suitable auxiliaries which may be used include, but are not limited to, sodium hydroxide, potassium hydroxide, TEA and MEA.

Bleaching agents for use in a cleaning compositions for lightening or whitening a substrate, include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the present cleaning compositions include, for example, chlorine-containing compounds such as a chlorine, a hypochlorite, and chloramine. Exemplary halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosures of which are incorporated by reference herein for all purposes). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The composition can include an effective amount of a bleaching agent. When the concentrate includes a bleaching agent, it can be included in an amount of about 0.1 wt. % to about 60 wt. %, about 1 wt. % to about 20 wt. %, about 3 wt. % to about 8 wt. %, and about 3 wt. % to about 6 wt. %.

The composition can include an effective amount of detergent fillers, which does not perform as a cleaning agent per se, but cooperates with the cleaning agent to enhance the overall cleaning capacity of the composition. Examples of detergent fillers suitable for use in the present cleaning compositions include sodium sulfate, sodium chloride, starch, sugars, $C_1$-$C_{10}$ alkylene glycols such as propylene glycol, and the like. When the concentrate includes a detergent filler, it can be included in an amount of about 1 wt. % to about 20 wt. % and between about 3 wt. % to about 15 wt. %.

A defoaming agent for reducing the stability of foam may also be included in the composition to reduce foaming. When the concentrate includes a defoaming agent, the defoaming agent can be provided in an amount of between about 0.01 wt. % and about 3 wt. %.

Examples of defoaming agents that can be used in the composition includes ethylene oxide/propylene block copolymers such as those available under the name Pluronic N3, silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein for all purposes.

The composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. When the concentrate includes an anti-redeposition agent, the anti-redeposition agent can be included in an amount of between about 0.5 wt. % to about 10 wt. %, and between about 1 wt. % and about 5 wt. %.

Stabilizing agents that can be used include primary aliphatic amines, betaines, borate, calcium ions, sodium citrate, citric acid, sodium formate, glycerine, maleonic acid, organic diacids, polyols, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include about 0 to about 20 wt. %, about 0.5 wt. % to about 15 wt. %, and about 2 wt. % to about 10 wt. %.

Dispersants that can be used in the composition include maleic acid/olefin copolymers, polyacrylic acid, and its copolymers, and mixtures thereof. The concentrate need not include a dispersant, but when a dispersant is included it can be included in an amount that provides the desired dispersant properties. Exemplary ranges of the dispersant in the concentrate can be between about 0 and about 20 wt. %, between about 0.5 wt. % and about 15 wt. %, and between about 2 wt. % and about 9 wt. %.

Various dyes, odorants including perfumes, and other aesthetic enhancing agents can be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

The active cleaning compositions of the invention can comprise a polyvalent metal complexing, sequestering or chelating agent that aids in metal compound soil removal and in reducing harmful effects of hardness components in service water. Sequestrant or chelating agents may be included in any deliver format useful for concentrations of the present invention. That is, solid and liquid concentrations alike benefit from the incorporation of a sequestrant. Typically, a polyvalent metal cation or compound such as a calcium, a magnesium, an iron, a manganese, a molybdenum, etc. cation or compound, or mixtures thereof, can be present in service water and in complex soils. Such compounds or cations can comprise a stubborn soil or can interfere with the action of either washing compositions or rinsing compositions during a cleaning regimen. A chelating agent can effectively complex and remove such compounds or cations from soiled surfaces and can reduce or eliminate the inappropriate interaction with active ingredients including the nonionic surfactants and anionic surfactants of the invention. Both organic and inorganic chelating agents are common and can be used. Inorganic chelating agents include such compounds as sodium tripolyphosphate and other higher linear and cyclic polyphosphates species. Organic chelating agents include both polymeric and small molecule chelating agents. Organic small molecule chelating agents are typically organocarboxylate compounds or organophosphate chelating agents. Polymeric chelating agents commonly comprise polyanionic compositions such as polyacrylic acid compounds. Small molecule organic chelating agents include sodium gluconate, sodium glucoheptonate, N-hydroxyethylenediaminetriacetic acid (HEDTA), ethylenediaminetetraacetic acid (EDTA), nitrilotriaacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof, ethylenediaminetetraacetic acid tetrasodium salt (EDTA), nitrilotriacetic acid trisodium salt (NTA), ethanoldiglycine disodium salt (EDG), diethanolglycine sodium-salt (DEG), and 1,3-propylenediaminetetraacetic acid (PDTA), dicarboxymethyl glutamic acid tetrasodium salt (GLDA), methylglycine-N-N-diacctic acid trisodium salt (MGDA), and iminodisuccinate sodium salt (IDS). All of these are known and commercially available. Small molecule organic chelating agents also include biodegradable sequestrants having combinations of chelating and hydrotroping functionalities from EDG, MGDA and GLDA-type molecules. Preferred sequestrants include ethanoldiglycine disodium salt (EDG), dicarboxymethyl glutamic acid tetrasodium salt (GLDA), and methylglycine-N-N-diacetic acid trisodium salt (MGDA), due to their biodegradability and their ability to bind easily with hydrotropes to form ultra-compact concentrates.

Delivery Modes

The concentrate composition of the invention can be provided as a solid, liquid, or gel. In one embodiment of the invention, the composition concentrate is provided as a capsule or pellet of compressed powder, a solid, or loose powder, either contained by a water soluble material or not. In the case of providing the capsule or pellet of the composition in a material, the capsule or pellet can be introduced into a volume of water, and if present the water soluble material can solubilize, degrade, or disperse to allow contact of the composition concentrate with the water. For the purposes of this disclosure, the terms "capsule" and "pellet" are used for exemplary purposes and are not intended to limit the delivery mode of the invention to a particular shape.

In another embodiment, the liquid concentrate composition can be diluted through dispensing equipment using aspirators, peristaltic pumps, gear pumps, mass flow meters, and the like. This liquid concentrate embodiment can also be delivered in bottles, jars, dosing bottles, bottles with dosing caps, and the like. The liquid concentrate composition can be filled into a multi-chambered cartridge insert that is then placed in a spray bottle or other delivery device filled with a pre-measured amount of water. The liquid concentrate composition can also be diluted at the manufacturing site and packaged as a ready-to-use (RTU) use solution.

In yet another embodiment, the concentrate composition can be provided in a solid form that resists crumbling or other degradation until placed into a container. Such container may either be filled with water before placing the composition concentrate into the container, or it may be filled with water after the composition concentrate is placed into the container. In either case, the solid concentrate composition dissolves, solubilizes, or otherwise disintegrates upon contact with water. In a preferred embodiment, the solid concentrate composition dissolves rapidly thereby allowing the concentrate composition to become a use composition and further allowing the end user to apply the use composition to a surface in need of cleaning.

In another embodiment, the solid concentrate composition can be diluted through dispensing equipment whereby water is sprayed at the solid block forming the use solution. The water flow is delivered at a relatively constant rate using mechanical, electrical, or hydraulic controls and the like. The solid concentrate composition can also be diluted through dispensing equipment whereby water flows around the solid block, creating a use solution as the solid concentrate dissolves. The solid concentrate composition can also be diluted through pellet, tablet, powder and paste dispensers, and the like.

Compositions of the invention may be useful to clean a variety of surfaces. Invention compositions may be used to clean soils on hard surfaces including but not limited to ceramics, ceramic tile, grout, granite, concrete, mirrors, enameled surfaces, metals including aluminum, brass, stainless steel and the like. Compositions of the invention may also be used to clean soiled linens such as towels, sheets, and nonwoven webs. As such, compositions of the invention are useful to formulate hard surface cleaners, laundry detergents, oven cleaners, hand soaps, automotive detergents, and warewashing detergents whether automatic or manual.

Compositions of the Invention

A few useful compositions for preparing basic compositions for a cleaning concentrate prepared according to the present invention include those provided in the following table. The skilled artisan will recognize that the invention may be prepared by varying either of the alkyl polyglucoside and alcohol ethoxylate ingredients within the upper and lower limits of the compositions provided. However, the alkyl polyglucoside may exceed the 18% by weight actives although diminishing returns are obtained when far exceeding the 18% actives since excellent cleaning ability is obtained with the 18% by weight actives concentration. In other words, the cost of adding more alkyl polyglucoside begins to outweigh the cleaning advantages when increasing the actives content much beyond the 18% by weight. The amounts of optional ingredients, including but not limited to chelating agents, water, solvent, and pH adjustor may be varied. For instance, a chelant may be provided in an amount from about 0 up to about 15 weight percent, from about 1 to about 10 weight percent, from about 3 to about 8 weight percent; solvent in an amount from about 0 up to about 15 weight percent, from about 1 to about 10 weight percent, from about 2 to about 7 weight percent, or up to about 5 weight percent; pH adjustor from about 0 up to about 5 weight percent, from about 0.0 1 to about 2 weight percent, and from about 0. 1 to about 1.5 weight percent.

| Component | % by weight | % by weight | % by weight |
|---|---|---|---|
| Actives Concentration (wt %) | 9 | 13.5 | 18 |
| Alkyl Polyglucoside (50% active) | 13.5 | 20.25 | 27 |
| Alcohol Ethoxylate | 2.25 | 3.375 | 4.5 |
| Chelant | 6 | 6 | 6 |
| Water | 74.35 | 66.475 | 58.6 |
| Solvent | 3.5 | 3.5 | 3.5 |
| pH Adjuster | 0.4 | 0.4 | 0.4 |

Any acid may be used as a pH adjuster. Sulfuric acid or phosphoric acid may be used. However, the skilled artisan will recognize the need to use an acid other than a phosphate-containing acid if a phosphate free composition is desirable.

Solvent Free

A feature of the composition of the invention is that it provides excellent degreasing ability yet in an embodiment it may remain substantially free of solvent. A solvent is often times useful in degreaser compositions to enhance certain soil removal properties. However, surprisingly, compositions of the invention do not require a solvent in order to perform well as degreasers. Compositions of the invention do not require a non-aqueous or aqueous solvent. However, compositions of the invention may include a solvent to adjust the viscosity of the final composition. The final use may be determinative of whether or not a solvent is included in compositions of the invention. If a solvent is included in compositions of the invention, it is usually a low cost solvent such as isopropyl alcohol. It should be noted that a solvent is not necessary to boost the effectiveness of compositions of the invention. Rather, a solvent may or may not be included to improve handleability or ease of use of the compositions of the invention. Solvents normally included in compositions useful to remove hydrophobic soils include oxygenated solvents such as lower alkanols, lower alkyl ethers, glycols, aryl glycol ethers and lower alkyl glycol ethers. Examples of other solvents unnecessary in compositions of the invention include but are not limited to methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether, and others.

If a solvent is used in compositions of the invention, a solvent is included in an amount up to about 15 weight percent, from about 1 to about 10 weight percent, from about 2 to about 7 weight percent, up to about 5 weight percent, or up to about 4 weight percent.

The above specification provides a basis for broadly understanding the invention. The present invention will be better understood from the examples that follow, all of which are intended to be illustrative only and not meant to unduly limit the scope of the invention. Unless otherwise indicated, percentages are on a weight-by-weight basis.

EXAMPLES

The following protocol was used to prepare and test red soil removal for the Examples.

Red Soil Preparation and Test Removal

A test soil consisting of lard, oil, protein, and iron (III) oxide for color was prepared. Thirty grams of lard was combined with 30 grams of corn oil, 15 grams of whole powdered egg, and 1.5 g Fe2O3.

The red test soil was applied onto the rough side of two 3"×3" vinyl tiles. Unless otherwise noted, the tiles were white. The tiles were then dried at room temperature overnight. The tiles were then placed into a soaking tray containing the cleaning composition for about 1 minute. A synthetic sponge was premoistened with 50 grams of cleaning composition and placed in a Gardner-type apparatus. The tiles were then placed in a Gardner-type apparatus wash tray, with the grain parallel to the direction of sponge travel. The tiles were then scrubbed with the moistened synthetic sponge for 16 cycles, rotating the tiles 90 degrees after 4 cycles for a complete 360 degree rotation of the tiles. The tiles were then rinsed with deionized water and dried overnight at room temperature. Hunter Lab L* reflectance of the unsoiled tiles, soiled tiles and washed tiles were measured. The soiled tiles L* reflectance value was manipulated in the following equation:

$$\text{manipulated soiled } L^* = \frac{1}{3.38 \ln\left(\frac{92.1 - 24.74}{\text{soiled } L^* - 24.74}\right)}$$

where 3.38, 92.1, and 24.74 are constants. The washed tiles L* reflectance value was manipulated in the following equation:

$$\text{manipulated washed } L^* = \frac{1}{3.38 \ln\left(\frac{92.1 - 24.74}{\text{washed } L^* - 24.74}\right)}$$

3.38, 92.1, and 24.74 are constants. The percent soil removal was then calculated as:

$$\text{percent soil removal} = \left(\frac{\text{manipulated soiled } L^* - \text{manipulated washed } L^*}{\text{manipulated washed } L^*}\right) * 100$$

Example 1

Compositions were prepared according to the Table 1 on a weight percent basis. The abbreviation, "Comp" refers to a Comparative Example. Sample Compositions B through K practice the present invention. Composition D(b) is identical to Composition D except the ethoxylated surfactant used to prepare the composition was from a different manufacturer. The same applies to samples F, F(b), F(c), and F(d) wherein the ethoxylated surfactant used to F(c) was Basophor HE 50 available from BASF located in New Jersey and in the case of F(b) the alkyl polyglucoside used was Seppic Simusol SL 55 available from Seppic located in New Jersey. The Control used in the samples was solely nonylphenol ethoxylate 9.5 mole, a composition largely unsavory from an environmental standpoint but deemed to be an excellent cleaner.

Comparative Examples II, III and III(b) were prepared to compare compositions of the invention (including a pure six carbon alcohol ethoxylate) against compositions including a blend of C6-C 10 alcohol ethoxylates. The Comparative Examples II, III and III(b) include the higher chain blend of alcohol ethoxylates.

TABLE 1

| | APG[1] (50% active) | EO[2] Surfactant | Water[3] | $H_3PO_4$[4] | IPA[5] | EDTA[6] | NPE[7] 9.5 Mole | % Actives |
|---|---|---|---|---|---|---|---|---|
| Control | 0 | 0 | 72.1 | 0.4 | 3.5 | 6 | 18 | 18 |
| B | 9 | 4.5 | 76.6 | 0.4 | 3.5 | 6.0 | 0 | 9 |
| C | 13.5 | 6.75 | 69.85 | 0.4 | 3.5 | 6.0 | 0 | 13.5 |
| D | 20.25 | 3.375 | 66.475 | 0.4 | 3.5 | 6 | 0 | 13.5 |
| D(b)[8] | 20.25 | 3.375 | 66.475 | 0.4 | 3.5 | 6 | 0 | 13.5 |
| E | 18 | 4.5 | 67.6 | 0.4 | 3.5 | 6 | 0 | 13.5 |
| F | 13.5 | 2.25 | 74.35 | 0.4 | 3.5 | 6 | 0 | 9 |
| F(b)[9] | 13.5 | 2.25 | 74.35 | 0.4 | 3.5 | 6 | 0 | 9 |
| F(c)[10] | 13.5 | 2.25 | 74.35 | 0.4 | 3.5 | 6 | 0 | 9 |
| F(d)[11] | 13.5 | 2.25 | 77.85 | 0.4 | 0 | 6 | 0 | 9 |
| G | 12 | 3 | 75.1 | 0.4 | 3.5 | 6 | 0 | 9 |
| H | 6.75 | 10.125 | 73.225 | 0.4 | 3.5 | 6 | 0 | 13.5 |
| I | 9 | 9 | 72.1 | 0.4 | 3.5 | 6 | 0 | 13.5 |
| J | 4.5 | 6.75 | 78.85 | 0.4 | 3.5 | 6 | 0 | 9 |
| K | 6 | 6 | 78.1 | 0.4 | 6.5 | 6 | 0 | 9 |
| Comp. I | 0 | 18 | 72.1 | 0.4 | 3.5 | 6.0 | 0 | 18 |
| Comp.[12] I(b) | 0 | 18 | 72.1 | 0.4 | 3.5 | 6 | 0 | 18 |
| Comp.[13] II | 13.5 | 6.75 | 69.85 | 0.4 | 3.5 | 6 | 0 | 13.5 |
| Comp.[14] III | 9 | 4.5 | 76.6 | 0.4 | 3.5 | 6 | 0 | 9 |
| Comp.[15] III(b) | 9 | 4.5 | 76.6 | 0.4 | 3.5 | 6 | 0 | 9 |
| Comp.[16] IV | 10.125 Genapol UD 070 | 3.375 | 76.6 | 0.4 | 3.5 | 6 | 0 | 13.5 |
| Comp.[17] V V | 10.125 Lutensol XP 80 | 3.375 | 76.6 | 0.4 | 3.5 | 6 | 0 | 13.5 |
| Comp.[18] VI | 10.125 Tomadol 1-7 | 3.375 | 76.6 | 0.4 | 3.5 | 6 | 0 | 13.5 |

TABLE 1-continued

| | APG[1] (50% active) | EO[2] Surfactant | Water[3] | $H_3PO_4$[4] | IPA[5] | EDTA[6] | NPE[7] 9.5 Mole | % Actives |
|---|---|---|---|---|---|---|---|---|
| Comp. VII | 36 | 0 | 54.1 | 0.4 | 3.5 | 6 | 0 | 18 |

[1]Glucopon 625 UP available from Care Chemicals, of the Cognis Group, unless otherwise noted
[2]Tomadol 6-3.5 available from Air Products unless otherwise noted
[3]zero grain
[4]75% solution
[5]isopropyl alcohol 99% solution
[6]40% solution
[7]Nonylphenol Ethoxylate 9.5 Mole
[8]Ethoxylated surfactant used was Basophor HE 50 available from BASF
[9]Alkyl polyglucoside used was Seppic Simusol SL 55 available from Seppic
[10]Ethoxylated surfactant used was Basophor HE 50 available from BASF
[11]Composition did not contain isopropyl alcohol
[12]Ethoxylated surfactant used was Basophor HE 50 available from BASF
[13]Ethoxylated surfactant used was Trycol ST 8049 available from Cognis
[14]Ethoxylated surfactant used was Trycol ST 8049 available from Cognis
[15]Alkyl polyglucoside used was Seppic Simusol SL 55 available from Seppic and ethoxylated surfactant used was Trycol ST 8049 available from Cognis
[16]Ethoxylated surfactant used was Genapol UD 070 available from Clariant
[17]Ethoxylated surfactant used was Lutensol XP 80 available from BASF
[18]Ethoxylated surfactant used was Tomadol 1-7 available from Air Products Comparative Examples I(b) and VII along with the Control from Table 1 above were diluted with water at the concentrations of 4 ounces per gallon of water, 8 ounces per gallon of water, and 16 ounces per gallon of water. Composition D(b) was diluted with water at the concentrations of 3 ounces per gallon of water, 6 ounces per gallon of water, and 12 ounces per gallon of water. The diluted compositions were used to clean red soil as described above. The graph of FIG. 1 shows the cleaning performance of Composition D(b), Comparative Examples I(b) and VII, and the Control. Composition D(b), prepared according to the invention, performed as well as the Control at a 12 oz/gallon dilution. Composition D(b), containing both the alkyl polyglucoside and the short chain ethoxylated surfactant performed better than the Comparative Example I(b), containing only the short chain ethoxylated surfactant. Comparative Example VII, has excellent cleaning performance but is prohibitively expensive when used alone as provided.

FIGS. 2 through 7 include plots demonstrating the compositions prepared according to Table 1. The compositions have varying percent actives. As shown well in FIG. 2, Compositions B and C prepared according to the present invention, performed very well as compared to the Control and far exceeded the cleaning ability of Comparative Example I comprised of only the ethoxylated surfactant.

Figure 3:
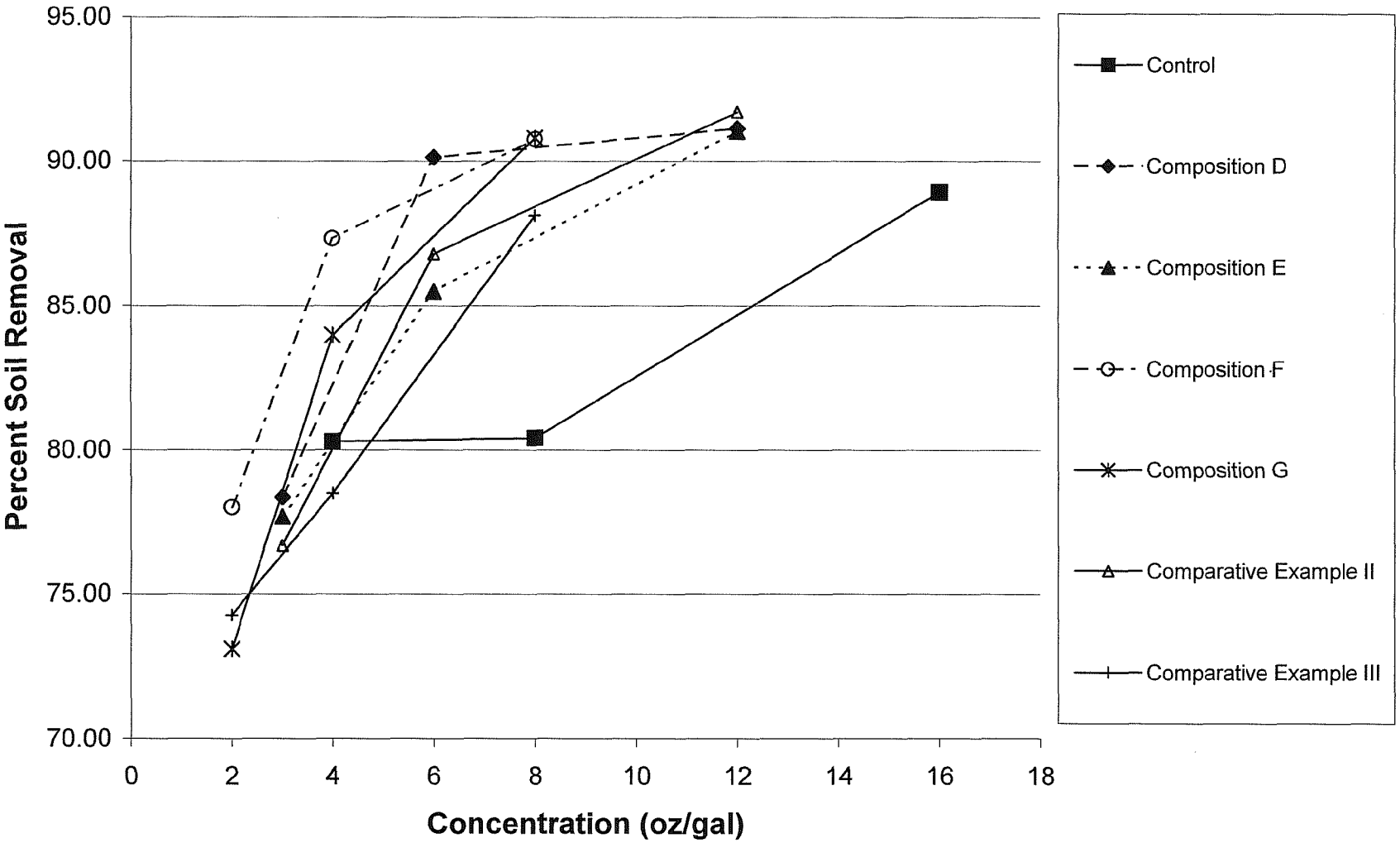

FIG. 3 shows Compositions D and E prepared according to the invention and Comparative Example II performed better than the Control at a 12 oz/gallon dilution. FIG. 3 also shows Compositions F and G prepared according to the invention and Comparative Example III performed better than the Control at a 8 oz/gallon dilution.

Figure 4:
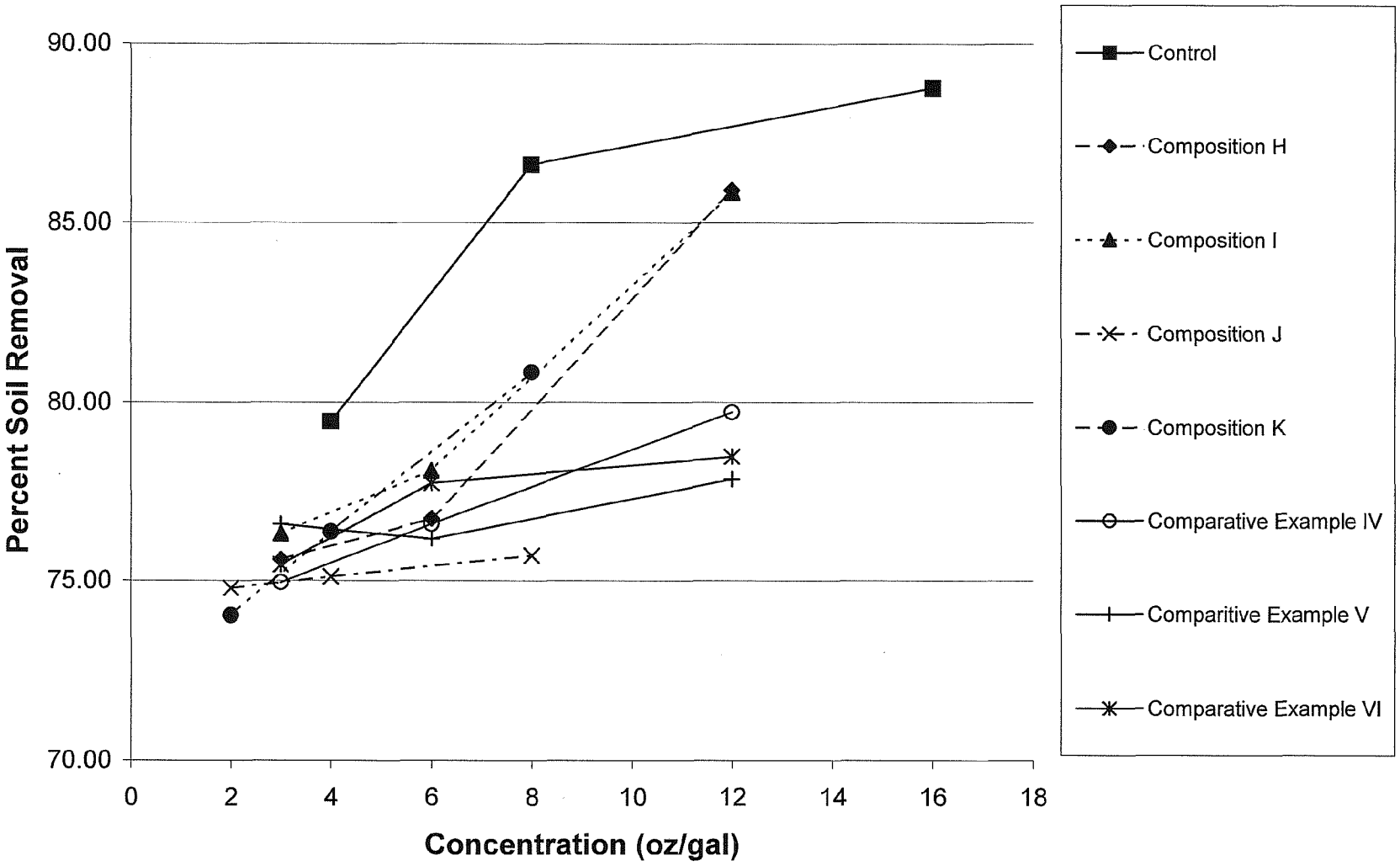

FIG. 4 shows Compositions H, I, J, and K prepared according to the invention did not perform better than the Control. Comparative Examples IV, V, and VI prepared according to the invention did not perform better than the Control. Compositions H, I, J, and K and Comparative Examples IV, V, and VI show that the ratio of alkyl polyglucoside to short chain ethoxylated surfactant is important and that substitutions for the alkyl polyglucoside do not achieve better performance.

Figure 5:
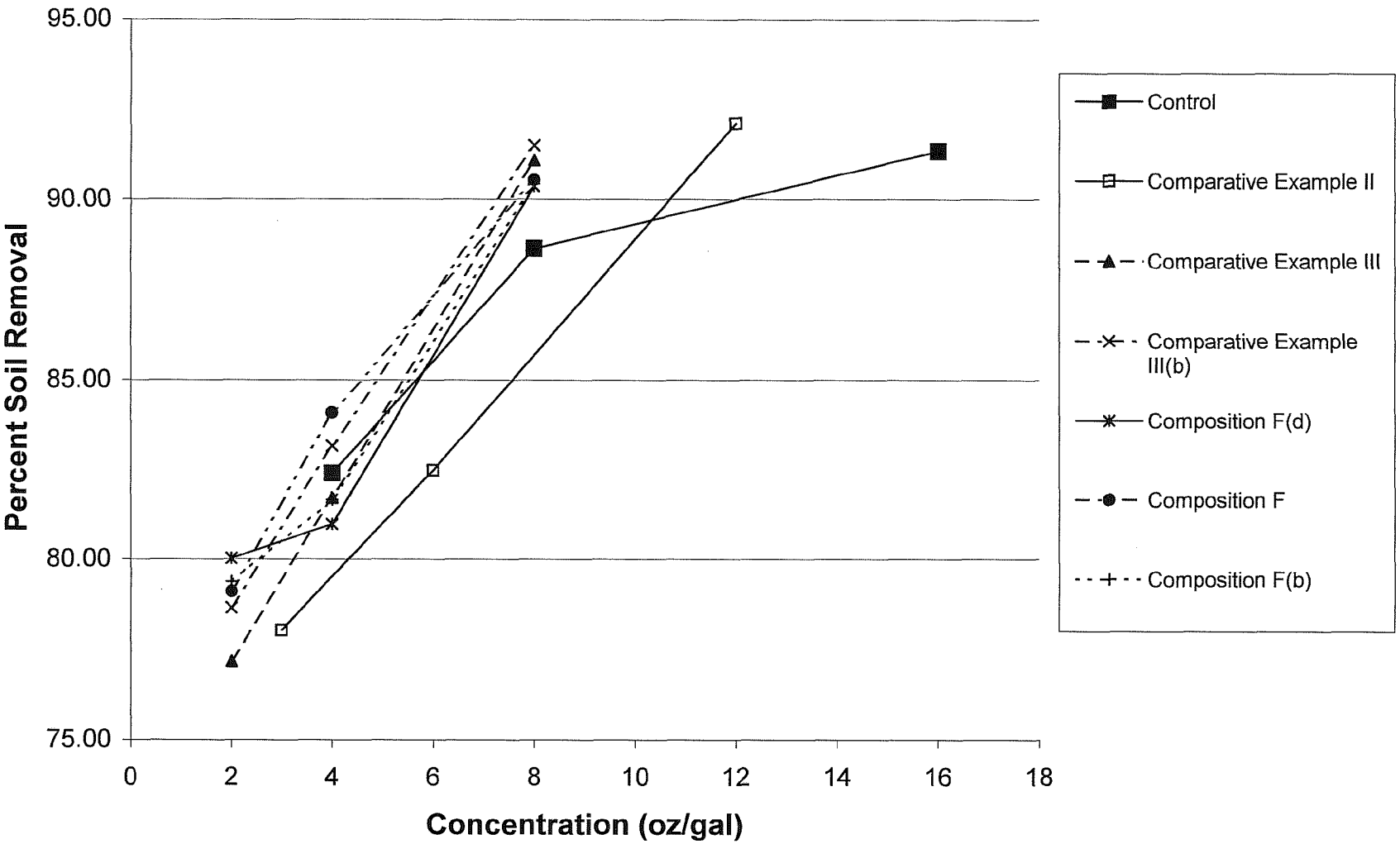

FIG. 5 shows Compositions F, F(b) and F(d) prepared according to the invention and Comparative Example III performed better than the Control at a 8 oz/gal dilution. Comparative Example II performed as well as the Control at a 12 oz/gal dilution.

Figure 6:
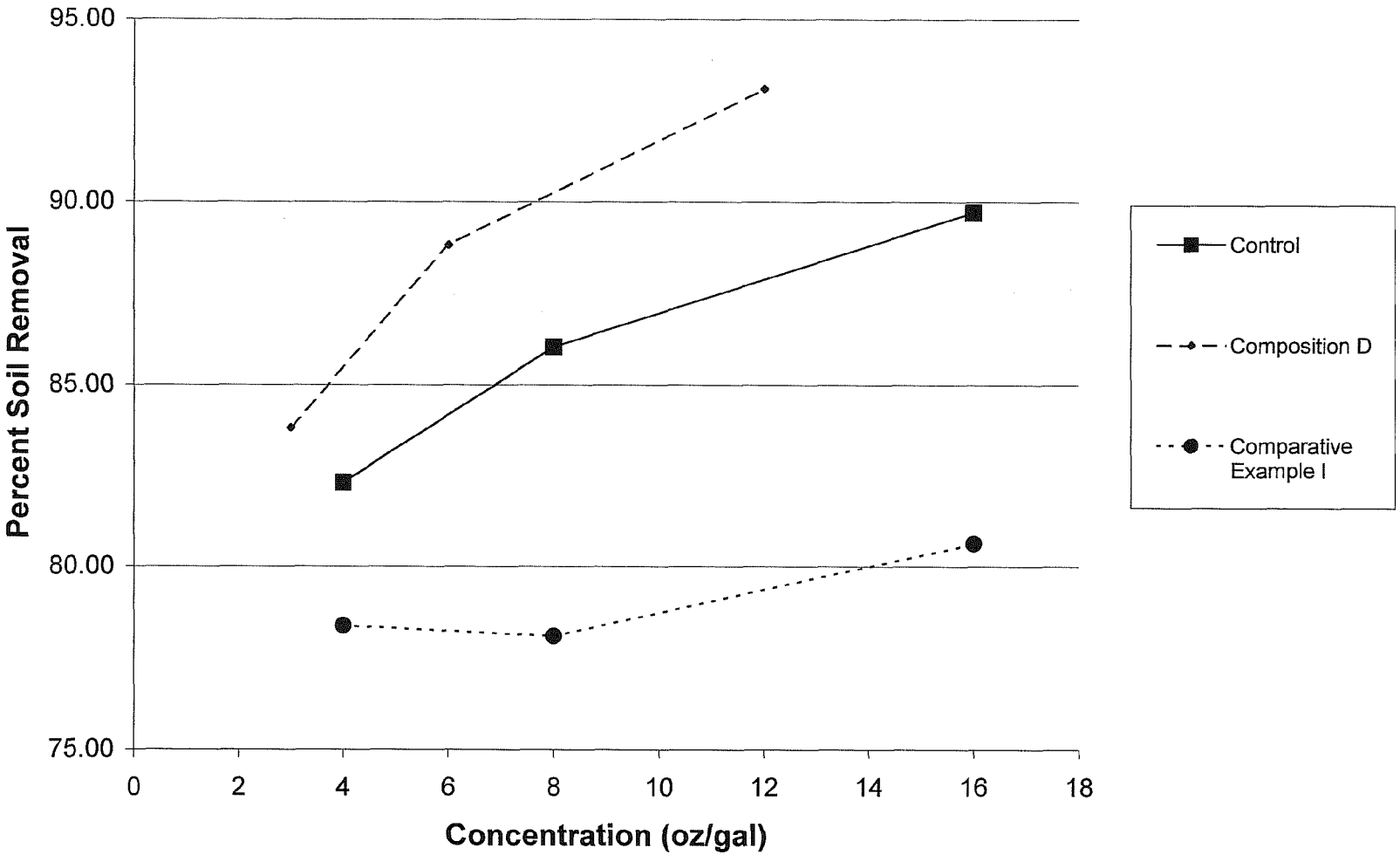

FIG. 6 shows Composition D prepared according to the invention performed better than the Control and far better than Comparative Example I.

Figure 7:
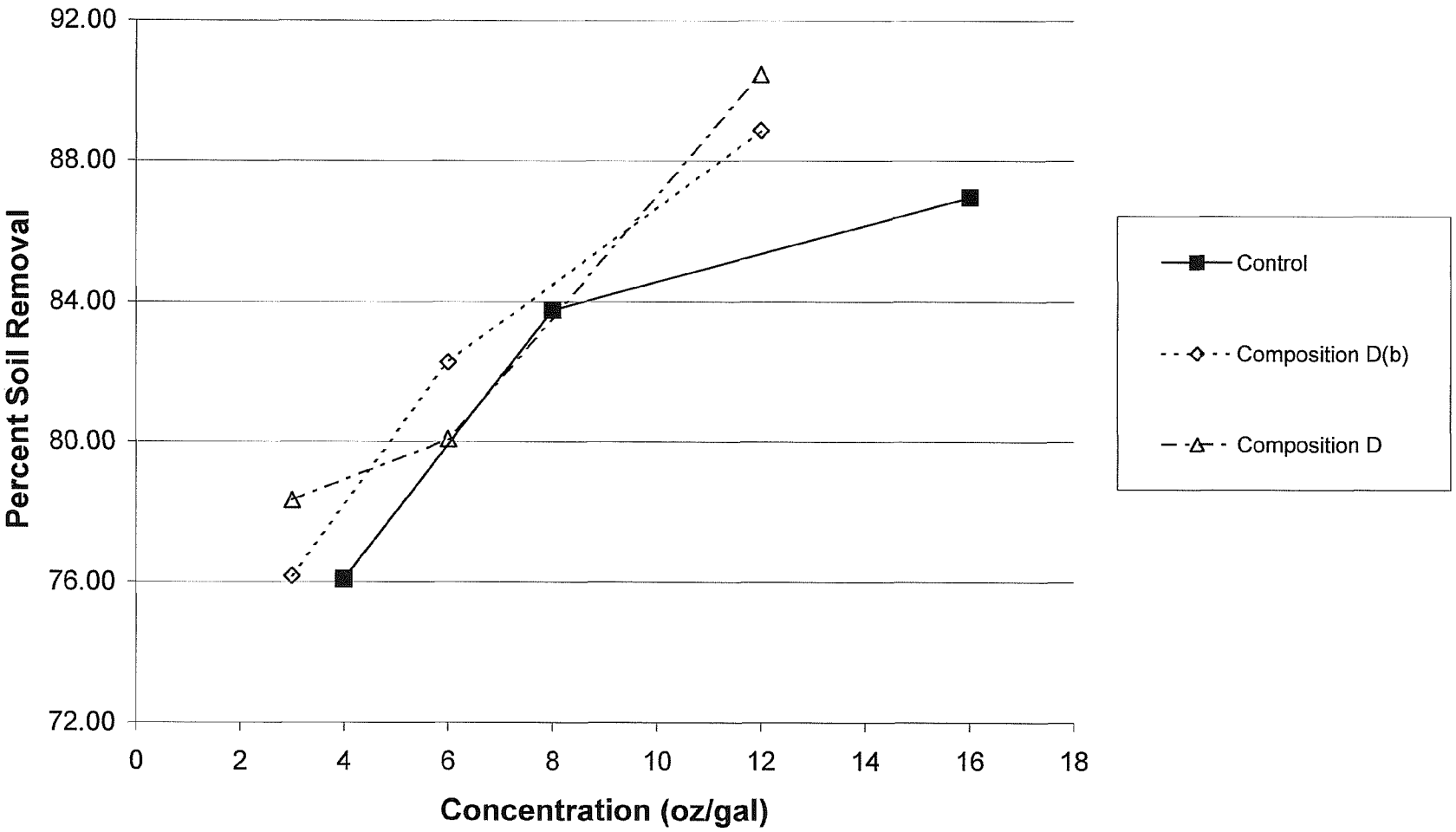

FIG. 7 shows Compositions D and D(b), prepared according to the invention, performed better than the Control at a 12 oz/gal dilution.

In summary, the Examples demonstrate that the invention provides an environmentally friendlier cleaner than NPE that performs very well.

The invention has been described with reference to various specific and preferred embodiments and techniques. However, it should be understood that many variations and modifications may be made while remaining within the spirit and scope of the invention.

We claim:

1. A method of removing protein-containing soils from a surface comprising applying a composition consisting essentially of an alkyl polyglucoside and a nonionic surfactant consisting essentially of $C_6$ alcohol ethoxylate wherein the alkyl polyglucoside and the alcohol ethoxylate comprise an active ratio of about 1:1 in the composition to the surface containing a protein-containing soil.

2. The method of claim 1 wherein the $C_6$ alcohol ethoxylate consists essentially of from about 3 to about 6 moles of ethylene oxide.

3. The method of claim 1 wherein the combination of alkyl polyglucoside and single nonionic surfactant consists essentially of between about 8 percent and 18 percent by weight actives.

4. The method of claim 1 wherein the surface the composition is applied to comprises laundry, a hard surface, dishes, hands, an oven, or an automotive.

5. The method of claim 1 wherein the composition applied to the surface consists essentially of less than about 5 percent by weight solvent.

6. The method of claim 1 wherein the composition applied to the surface is substantially solvent free.

7. The method of claim 1 wherein the composition applied to the surface is diluted in water by about 1 to about 256 times.

* * * * *